United States Patent [19]

Luscombe

[11] 3,931,655

[45] Jan. 13, 1976

[54] INFLATABLE BOAT

[76] Inventor: Terry L. Luscombe, Armstrong, Iowa 50514

[22] Filed: Jan. 21, 1974

[21] Appl. No.: 435,301

[52] U.S. Cl. ..... 9/2 A
[51] Int. Cl.[2] ..... B63B 7/08
[58] Field of Search ..... 9/2 R, 2 A, 2 S, 11 R, 9/11 A

[56] References Cited

UNITED STATES PATENTS

| | | | |
|---|---|---|---|
| 2,443,767 | 6/1948 | House | 9/2 S |
| 2,639,750 | 5/1953 | Phane | 9/11 A |
| 2,987,735 | 6/1961 | Nail | 9/11 A |
| 3,348,246 | 10/1967 | Vidal | 9/2 S |
| 3,497,886 | 3/1970 | Burnett et al. | 9/6 |
| 3,566,425 | 3/1971 | Welty | 9/2 A |

*Primary Examiner*—Trygve M. Blix
*Assistant Examiner*—Gregory W. O'Connor
*Attorney, Agent, or Firm*—Williamson, Bains & Moore

[57] ABSTRACT

An inflatable boat is preferably of sectional construction and includes a bow section, an intermediate section and a stern section which are releasably secured together. Each boat section is comprised of inflatable side members that are of generally rectangular configuration and which form the sides of the boat. Inflatable transverse members of each section are secured together and serve as seats for the boat. The sections may be readily disconnected from each other, and each section may then serve as a small buoyant craft.

1 Claim, 7 Drawing Figures

INFLATABLE BOAT

SUMMARY OF INVENTION

This invention relates to inflatable boats.

Although there are many kinds of inflatable water craft, most of these inflatable craft are usually referred to as rafts, and the periphery of these prior art inflatable craft is usually formed by an inflatable ring and therefore does not have the configuration of a boat. Although some of these prior art inflatable craft do have a tapering boat-like shape, these prior art craft have a relatively shallow profile and the inflated peripheral ring thereof is circular in cross-sectional configuration.

It is therefore a general object of this invention to provide a novel inflatable boat, which has the general configuration and shape of conventional boats and which has a relatively deep profile. The inflated sides of the boat are of generally uniform cross-sectional configuration and each section when disassembled may function as a small buoyant craft.

This novel inflatable boat may be readily assembled and inflated and may also be readily disassembled into a small compact structure to facilitate storage and transport.

These and other objects and advantages of this invention will more fully appear from the following description made in connection with the accompanying drawings wherein like reference characters refer to the same or similar parts throughout the several views.

FIGURES OF THE DRAWINGS

DESCRIPTION OF THE PREFERRED EMBODIMENT OF THE INVENTION

Figure 1:
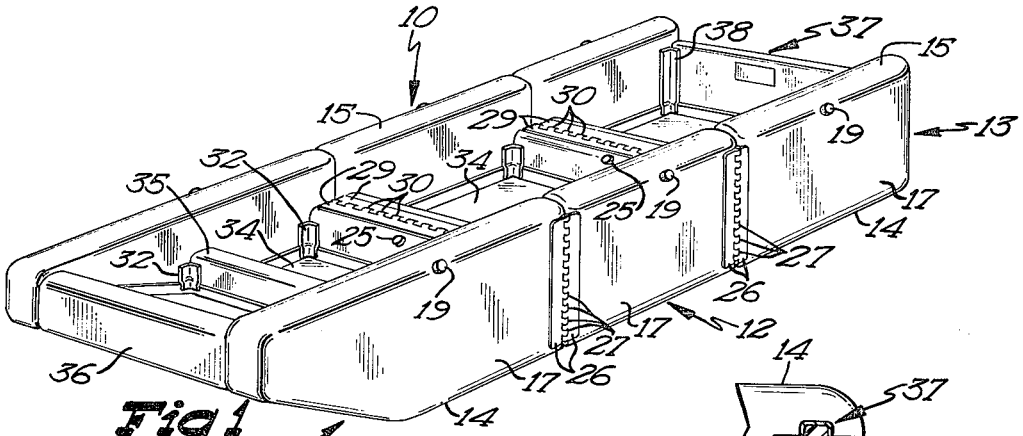
FIG. 1 is a front perspective view of the novel inflatable boat.

Referring now to the drawings and more specifically to FIG. 1, it will be seen that one embodiment of the novel inflatable boat, designated generally by the reference numeral 10, is there shown. The inflatable boat 10 is comprised of a plurality of boat sections which are releasably secured together and which includes a bow section 11, an intermediate section 12 and a stern section 13. It is pointed out that while only a single intermediate section 12 is shown in the present embodiment, a plurality of such intermediate sections may be provided to increase the overall length of the boat, or alternatively, the bow section may be connected directly to the stern section. It is preferred, however, that the sectional boat include at least one intermediate section.

Figure 2:
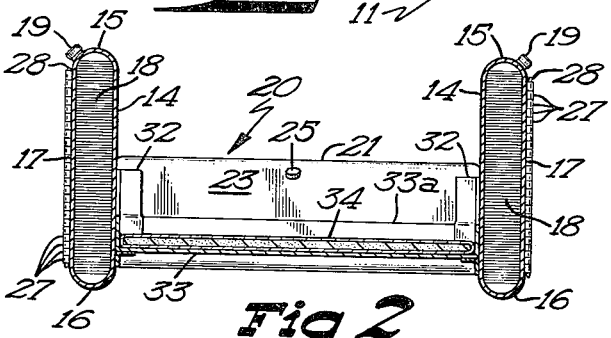
FIG. 2 is a cross-sectional view taken approximately along line 2—2 of FIG. 1 and looking in the direction of the arrows.

Each of the boat sections is comprised of a pair of spaced apart generally parallel upright inflatable side members 14. Each of these inflatable side members is of generally rectangular shape with the exception of the side members for the bow section 11, and each side member is of generally uniform cross-sectional configuration, as best seen in FIG. 2. Each of the side members is formed of a suitable air and liquid impervious material, preferably rubber, and each includes an upper wall element 15, a lower wall element 16, opposed vertical side wall elements 17 and opposed end wall elements 17*a*.

A plurality of filaments or threads 18 are bonded to and extend between the side wall elements 17 of each side member and these filaments are preferably formed of nylon and are bonded to substantially the entire inner surface area of the vertical side wall elements. In this respect, it will be noted that the side members are of also generally rectangular cross-sectional configuration, as best seen in FIG. 2. A suitable valve 19 is provided to permit inflation and deflation of the side members as desired.

It will be noted that the side members of the bow section 11 has a lower wall which includes an upwardly and forwardly tapering portion 16*a* so that the forward end wall element is of diminished size. In the embodiment shown, the vertical dimension of each of the side members is substantially greater than the transverse dimension from one side of wall element 17 to the other side wall element thereof and in the embodiments shown, this vertical dimension is in excess of thirty six inches.

Each of the boat sections include one or more inflatable transverse members 20, each extending between and being secured to the associated pair of inflatable side members 14. Each of the inflatable transverse members 20 is also formed of an impervious flexible material such as rubber or the like, and each includes an upper wall element 21, a lower wall element 22, opposed side wall elements 23 and opposed end wall elements 23*a*. These transverse members are also rectangular in shape and the inner surface areas of the side wall elements have filaments or threads 24 bonded thereto and extending therebetween.

Figure 3:
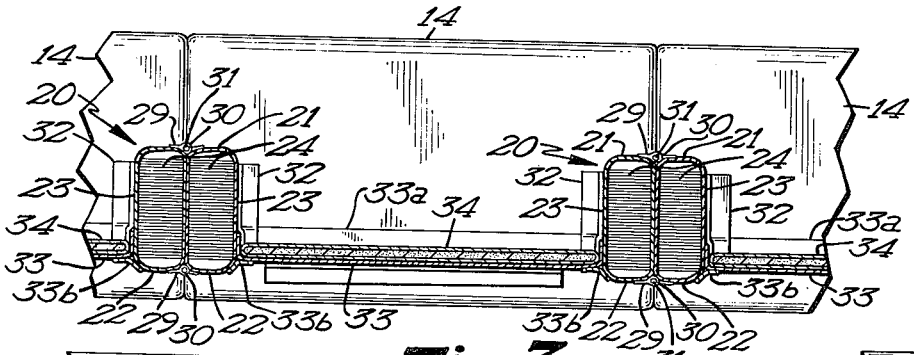
FIG. 3 is a longitudinal sectional view taken approximately along lines 3—3 of FIG. 1 and looking in the direction of the arrows.

Referring now to FIG. 3, it will be noted that the transverse members 20 are of generally rectangular cross-sectional configuration when in the inflated condition, and each is provided with a valve 25 to permit inflation and deflation thereof, as desired. It will be noted that the transverse members 20, also have a height dimension substantially greater than the cross-sectional dimension thereof, but the height dimension of the transverse members is substantially less than the corresponding vertical dimension of the side members 14.

Each of the transverse members 20 extend between and is bonded to an associated pair of side members 24. To this end, a bonding flap 32 extends between and is bonded to an associated pair of side members 24. Specifically, a bonding flap 32 extends between and is bonded to the inner side wall elements of each side member and to the inner side wall element of each transverse member adjacent the respective ends thereof as best seen in FIG. 1. These bonding flaps are preferably formed of rubber or the same material as the side and transverse members.

In the embodiments shown in FIG. 1, the bow section 11 is provided with a transverse member 20 adjacent its rear or stern end portion thereof and is also provided with a pair of transverse members adjacent the bow end thereof, including an upper bow member 35 and a lower bow member 36. The upper bow member and the lower bow member extend between, engage and are bonded to the side members 14 of the bow section in the same manner as the rear transverse member. It is also pointed out that the upper and lower bow members are identical in construction, size and shape to the remaining transverse members.

Means are also provided for releasably securing the boat sections together and to this end, each of the side members 14 has an elongate vertically disposed attachment flap 26 bonded to the outer side wall elements thereof which is adjacent the end thereof. The attachment strap is also preferably made of a flexible, yieldable material such as rubber and in the embodiments shown, the rear ends of the side members are provided with attachment straps while the forward ends of the side members of the stern section is provided with attachment straps. Opposite ends of the side members for each intermediate section has attachment strap 26 secured thereto.

Each of the attachment flaps 26 is provided with a plurality of vertically spaced apart loops 27 so that the loops of attachment flaps for adjacent sections may be disposed in interlaced registering relation to permit the reception of an elongate attachment element 28 therethrough. The attachment element 28 is preferably a non-metallic semi-rigid member preferably formed of a suitable plastic material, such as nylon or the like, and when extended through the loops of the flaps effectively secures adjacent boat sections together in end-to-end abutting relation.

It will be noted that when the sections are secured together in end-to-end relation, the adjacent end wall elements of abutting side members abut against each other so that the side members form a continuous side for the boat. The adjacent side wall element of abutting transverse members also engage each other so that upper wall element for a pair of abutting transverse members defines a continuous surface. These abutting transverse members located between the intermediate section and the bow and stern sections thereby function as seats for the boat.

Means are provided for securing the abutting transverse members together and to this end, each transverse member which functions as a seat is provided with a pair of attachment flaps 29 one of which is bonded to the upper wall element of the transverse member and the other flap being bonded to the lower wall element of the transverse member. These attachment flaps are formed of the same material and are substantially identical in construction to the attachment flaps 26 and each includes a plurality of spaced apart loops 30 which may be disposed in interlaced registering relation with the loops of attachment flaps on the adjacent abutting transverse member. The adjacent flaps may be secured together by suitable elongate attachment elements 31 which are also identical in construction to the attachment elements 28 associated with the side members 14. It will therefore be seen that the transverse members not only abut each other throughout the area defined by the adjacent side walls, but these abutting transverse members are also secured together along upper and lower transverse lines. Thus the connections between adjacent boat sections not only provides a positive interlocked structure, but one which may be readily released by merely removing the elongate attachment elements.

Each boat section also is provided with a bottom sheet 33 which actually defines the bottom wall and which is bonded to the associated side and transverse members thereof. In the embodiments shown, the bottom sheet is preferably formed of an impervious material such as rubber and is actually spaced slightly above the lower wall elements of the side members as best seen in FIG. 2 to permit planing of the boat at high speeds. In this respect, the bottom sheet 33 may be secured to the inner side wall elements of the associated side and transverse members adjacent the lower portions thereof.

Since the bottom sheet 33 which defines the bottom wall of the boat sections is of flexible construction, it is preferred that a relatively non-yieldable floor be provided and, to this end, each section is provided with a buoyant panel 34 which is shaped and sized to be positioned upon the bottom sheet and between the associated side and transverse members. The buoyant panel 34 for each boat section is preferably formed of a foamed core such as polyurethane foam which is provided with a fiberglass skin. Since each panel is buoyant, each of these panels will add to the buoyancy of the boat.

Figure 7:
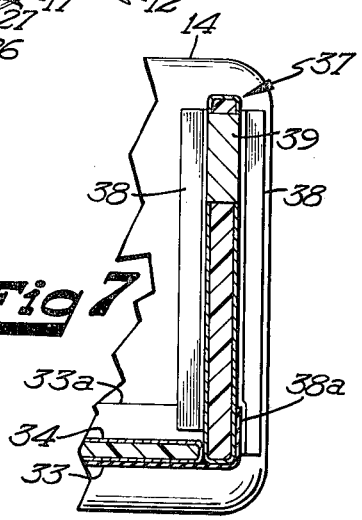
FIG. 7 is a cross-sectional view taken approximately along lines 7—7 of FIG. 1 and looking in the direction of the arrows.
Figure 5:
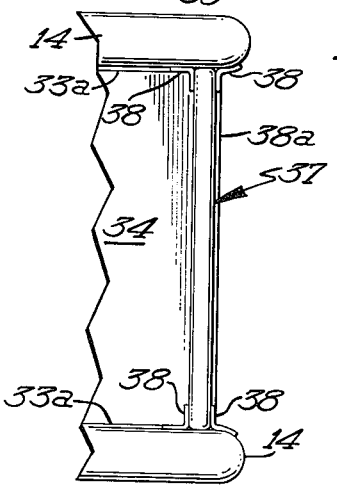
FIG. 5 is a fragmentary plan view of the stern of the boat illustrating details of construction thereof.
Figure 6:
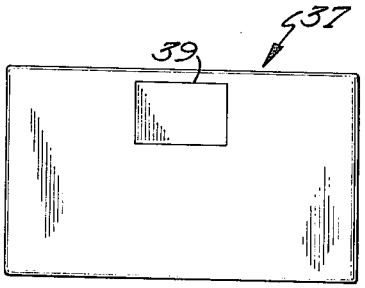
FIG. 6 is an elevational view of the transom of the boat.
Figure 4:
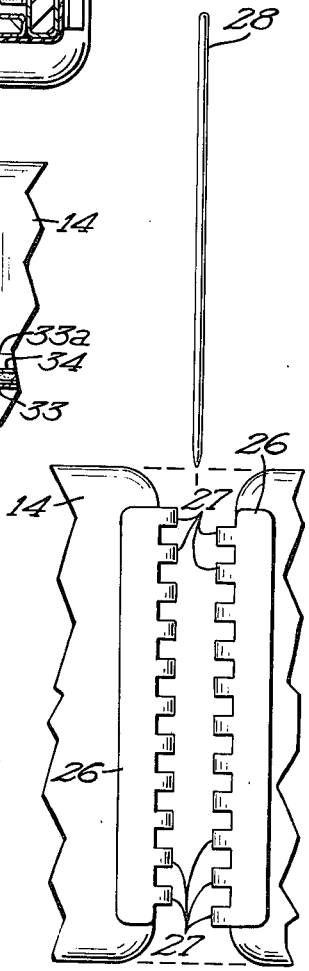
FIG. 4 is an enlarged fragmentary elevational view illustrating the means of attaching adjacent sections together.

Referring now to FIGS. 1, 5 and 6, it will be seen that the stern section 13 illustrated is provided with a generally rectangular shaped transom 37 which is formed of a non-metallic material such as plastic or the like and which extends between and is secured to the side members of the stern section by pairs of bonding flaps 38. The pairs of bonding flaps 38 are preferably formed of rubber or the like and are bonded to the side members of the stern section and to the front and rear surfaces of the transom. In the event that the transom is formed of a buoyant material such as polyurethane, having a fiberglass skin, then it is preferred that a mounting panel 39 in the form of an insert be provided. The mounting panel 39 is formed of a non-compressable material such as wood or the like and is embedded or otherwise snugly fitted within a recess in the transom. It will also be noted, as best seen in FIG. 7, that the bottom sheet 33 of the stern section extends beyond and folded over the rear surface of the panel and is bonded thereto to form a water-tight connection thereat.

In use, the boat sections may be secured together and inflated or may be partially or completely inflated and then secured together. When the boat sections are secured together, the inflated side members and the inflated transverse members are quite rigid, having a rigidity corresponding to the conventional materials of which smaller crafts are constructed. This rigidity, together with the manner in which the boat sections are coupled together, present a relatively high strength monolithic structure whose configuration is very similar to the conventional boats. The width dimension of the embodiment illustrated, is approximately seven feet from the inner side wall element of one side member to the inner side wall element of the other side member. The boat is approximately twenty one feet long and when operated at relatively high speeds by an outboard motor, will plane on the lower surfaces of the side members. Although the boat has a relatively shallow draw because of its high degree of buoyancy, the vertical dimensions of the side members (in excess of three feet) provide a boat with a deep profile and thereby minimize the danger of a person accidently falling overboard. The rectangular configuration of the side and transverse members and especially the ratio of the relatively small transverse dimensions to the vertical dimension of each side member provides an inflatable buoyant craft which completely departs in shape and design from any heretofore known conventional inflatable drafts. Further, the use of transverse fibers to reinforce and permit the side and transverse members to maintain their cross-sectional shape provides an inflatable craft having strength characteristics not heretofore possible with conventional prior art inflatable craft.

It is also pointed out that each individual boat section may be disassembled and when inflated may serve as a smaller inflated craft if desired. When the entire sectional boat is disassembled and deflated, the entire boat in this deflated disassembled condition will present a structure of relatively small compass which may be readily stored in any convenient storage area, such as a closet or garage or the like. Thus, the space problem of boat storage (for conventional draft) will be completely avoided with the novel inflatable craft.

From the foregoing description, it will be seen that I have provided a novel inflatable boat which is not only of simple and inexpensive construction, but one which completely departs from conventional prior art inflatable craft in both design and construction.

What is claimed is:

1. An inflatable boat comprising:

opposed substantially parallel elongate upright inflated side members, a plurality of similar longitudinally spaced apart elongate inflatable transverse members extending between and engaging said side members, one of said transverse members extending between said side members adjacent the front end thereof, said transverse members having a vertical dimension substantially less than the vertical dimension of said side members, each of said side and transverse members being formed of a flexible and impervious material and when inflated, being of substantially rectangular cross-sectional configuration and including opposed, substantially parallel vertical side wall elements, opposed end wall elements, top wall elements and a lower wall element, a plurality of fibers extending between and being bonded to the inner surface area of the vertical wall elements of each side and transverse member, each side and transverse member having a valve therein to permit inflation and deflation thereof, each of said side and transverse members when inflated having a vertical dimension substantially greater than the transverse dimension thereof, means sealingly connecting the respective end portions of a transverse member, said side members having a flexible impervious panel sealingly secured to the lower portions of the transverse and side members and defining a flexible floor, a rigid substantially flat floor defining panel positioned upon said flexible floor panel and extending between said side members, and a rigid, vertical transom extending between and sealingly secured to the side members and flexible floor member adjacent the rear ends thereof.

* * * * *